US005299494A

United States Patent [19]

Peters

[11] Patent Number: 5,299,494

[45] Date of Patent: Apr. 5, 1994

[54] STENCIL DRIVE WITH MAIN AND AUXILIARY DRIVE MEANS

[75] Inventor: Henricus J. Peters, Cuijk, Netherlands

[73] Assignee: Stork Brabant B.V., Netherlands

[21] Appl. No.: 999,660

[22] Filed: Dec. 29, 1992

Related U.S. Application Data

[63] Continuation of Ser. No. 540,217, Jun. 19, 1990, abandoned.

[30] Foreign Application Priority Data

Jun. 26, 1989 [NL] Netherlands ..... 8901608

[51] Int. Cl.[5] ..... B41L 13/04

[52] U.S. Cl. ..... 101/116; 74/409

[58] Field of Search ..... 101/116, 117, 118, 119, 101/120, 228, 115, DIG. 41; 74/661, 665 A, 409

[56] References Cited

U.S. PATENT DOCUMENTS 1,526,266 2/1925 De Smet .
1,588,318 6/1926 De Smet .
3,478,514 11/1969 Parker ..... 74/409
3,576,106 4/1971 Nowicki ..... 74/661
3,992,961 11/1976 Saito ..... 74/409

FOREIGN PATENT DOCUMENTS 1611333 10/1967 Fed. Rep. of Germany .
2448327 4/1975 Fed. Rep. of Germany .
2605016 8/1977 Netherlands .

*Primary Examiner*—Edgar S. Burr
*Assistant Examiner*—Ren Yan
*Attorney, Agent, or Firm*—Deveau, Colton & Marquis

[57] ABSTRACT

Device for driving at least one rotary screen printing stencil, comprising first main drive means having a first gear wheel which meshes with a circular toothed element which is connected to the stencil, and the axis of which coincides with the axis of the stencil, second main drive means for moving a web to be printed at right angles to the axis of the stencil and against the stencil, the first and second main drive means being synchronized with each other and an auxiliary drive means with a second gear wheel which meshes with the toothed element, while the auxiliary drive means constantly deliver such a couple that one of the gear wheels drives the stencil and the other gear wheel retains the stencil.

4 Claims, 2 Drawing Sheets

STENCIL DRIVE WITH MAIN AND AUXILIARY DRIVE MEANS

This is a continuation of copending application Ser. No. 07/540,217 filed on Jun. 19, 1990, now abandoned.

BACKGROUND OF THE INVENTION

The invention relates to a device for driving at least one rotary screen printing stencil, comprising first main drive means having a first gear wheel which meshes with a circular toothed element which is connected to the stencil, and the axis of which coincides with the axis of the stencil, and second main drive means for moving a web to be printed at right angles to the axis of the stencil and against the stencil, the first and second main drive means being synchronized with each other.

Such a device, which is known in practice, has the disadvantage that with varying web speed or varying friction between the web to be printed and the stencil, for example as a result of varying viscosity of the printing ink used, the peripheral speed of the stencil varies through the occurrence of play between the teeth of the first gear wheel and the teeth of the toothed element of the stencil. As a result, jumps can occur in a pattern printed by the stencil, while the jumps of patterns printed by different stencils are independent of each other, and the quality of the printed web can deteriorate in a clearly perceptible manner. In an attempt to find a solution to this problem, the speed of the web can be selected so that it is higher than the peripheral speed of the stencil, so that the stencil is, as it were, driven by the web and retained by its drive. However, in this case also, for the above-mentioned reasons, this does not offer a completely reliable solution.

SUMMARY OF THE INVENTION

The object of the invention is to eliminate this problem.

For achieving this object, a device of the type mentioned in the preamble is according to the invention characterized by first auxiliary drive means with a second gear wheel which meshes with the toothed element, while the first auxiliary drive means constantly deliver such a couple that one of the gear wheels drives the stencil and the other gear wheel retains the stencil. The first and second main drive means in this case can have separate synchronized motors or a single common motor. The toothed element can be a gear wheel or gear ring. This means that the same surfaces of the teeth of the first gear wheel and of the toothed element can always be kept in contact with each other, as a result of which the occurrence of jumps in a pattern printed on the web by the stencil is counteracted, because the drive of the first gear wheel and the drive of the web are synchronized.

If the first main drive means, as known per se, comprise a main shaft which is driven by a motor and is coupled by a number of gear sets to respective first gear wheels of a corresponding number of stencils, the device according to the invention preferably comprises second auxiliary drive means with a third gear wheel which meshes with a fourth gear wheel fixed on the main shaft, the second auxiliary drive means delivering such a couple that the third gear wheel drives the main shaft and the fourth gear wheel retains the main shaft. This prevents plays occurring between meshing gear wheels of the gear sets from being passed through, which means that the occurrence of jumps in the patterns printed by the stencils is further counteracted.

DETAILED DESCRIPTION OF PREFERRED EMBODIMENTS

Figure 1:
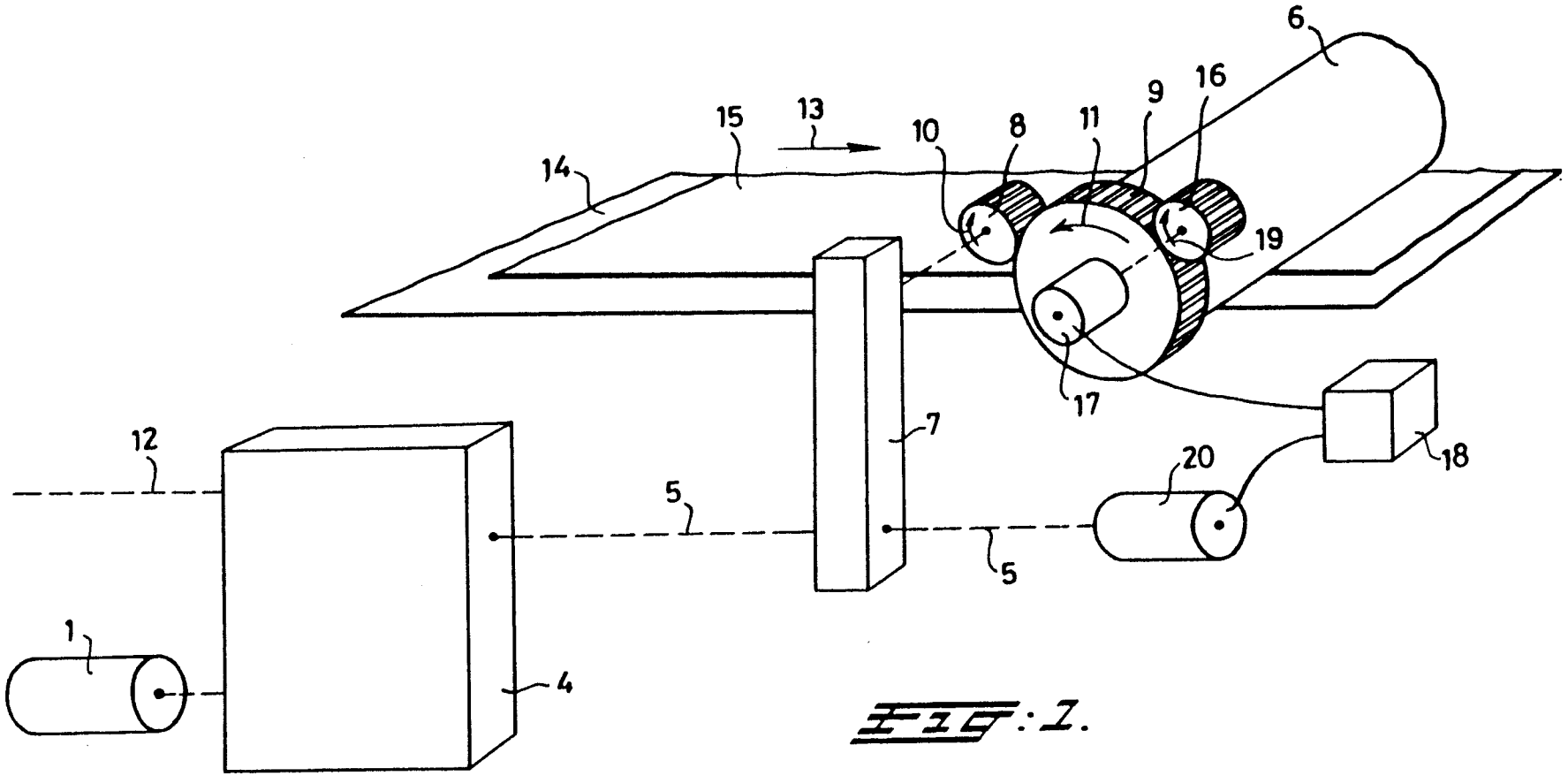
FIG. 1 shows schematically a part of a rotary screen printing device in which the invention is used.

In the device shown partially in FIG. 1, the dashed lines represent shafts. The device shown in FIG. 1 comprises a main motor 1, which is connected by means of a reduction gear unit 4 to a main shaft 5 which in the case of each stencil 6 by means of a schematically shown gear set 7 is coupled to a first gear wheel 8 which meshes with a gear ring 9 connected to the stencil 6. The gear wheel 8 turns in the direction indicated by the arrow 10, so that it can drive the stencil 6 in the direction indicated by the arrow 11.

Another outgoing shaft 12 of the reduction gear unit 4 can be coupled to drive means (not shown) for driving, in the direction indicated by the arrow 13, an endless conveyor belt 14 having thereon a web 15 to be printed, which in the case of the stencil 6 is pressed between the stencil 6 and the belt 14.

According to the invention, the device contains for each stencil a second gear wheel 16 which meshes with the gear ring 9 of the stencil 6, and which is driven by an auxiliary motor 17, which is connected to a power supply 18 for driving the gear wheel 16 in the direction indicated by the arrow 19.

Figure 2:
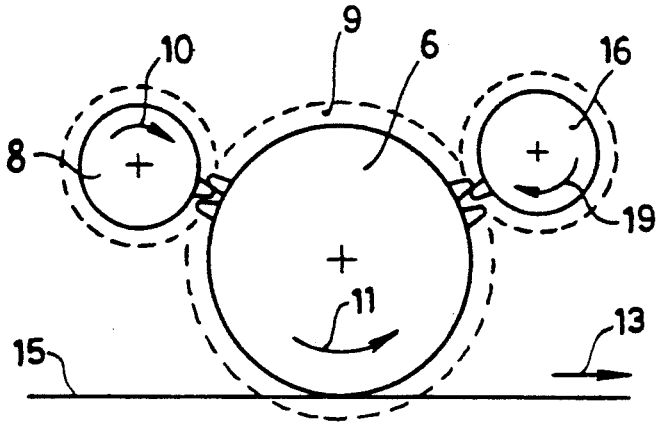
FIG. 2 shows schematically a first driving method of a stencil.
Figure 3:
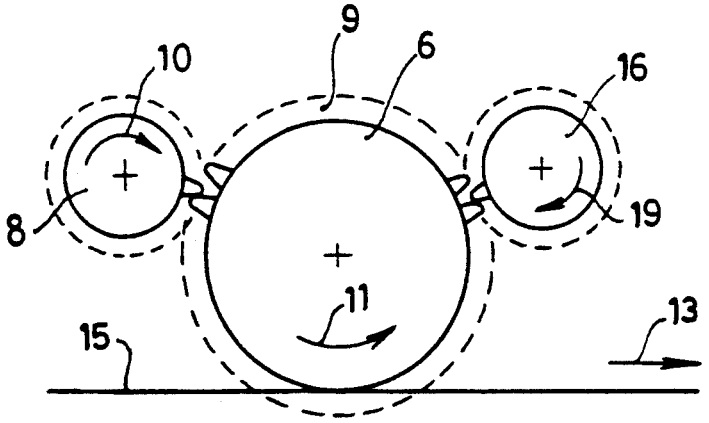
FIG. 3 shows a second driving method of a stencil.

FIGS. 2 and 3 show schematically the relative positions of the teeth of the gear wheels 8 and 16 with respect to the teeth of the gear ring 9 of the stencil 6 in the case where the gear wheel 16 (FIG. 2) or the gear wheel 8 (FIG. 3) drive the stencil 6 and where this drive is braked by the gear wheel 8 (FIG. 2) or the gear wheel 16 (FIG. 3). Since the speed of rotation of the gear wheel 8, through the synchronization with the conveyance of the web 15, and of the drive of the gear wheel 8, in particular through use of a common motor 1, is proportional to the speed of the web 15, the auxiliary motor 17, irrespective of its power, will not be able to give the stencil 6 a higher speed of rotation than a speed of rotation determined by the speed of rotation of the gear wheel 8.

If the auxiliary motor 17 is not provided, and if the stencil 6 is not driven faster by the web 15, the relative positions of the gear wheel 8 and the gear ring 9 shown in FIG. 3 will occur. If the friction between the stencil 6 and the web increases, the stencil 6 will be driven more by the web 15, as a result of which the contact pressure between the teeth of the gear wheel 8 and of the gear ring 9 decreases and the play between the above-mentioned teeth can be passed through, so that a jump in a pattern printed by the stencil 6 on the web 15 can occur. If the friction then decreases and the stencil 6 is driven less by the web 15, the play can be passed through again in the opposite direction, which again means that a jump occurs.

If provision is made for the auxiliary motor 17, which in the situation of FIG. 2 supplies sufficient power for driving the stencil 6, the situation shown in FIG. 2 will always be maintained, regardless of the friction between the stencil 6 and the web 15, so that the occurrence of jumps in the printed patterns is prevented.

If provision is made for the auxiliary motor 17, which in the situation of FIG. 3 has a braking effect on the driving force on the stencil 6 supplied by the gear wheel 8, the situation shown in FIG. 3 will be maintained, regardless of the friction between the stencil 6 and the web 15, so that the occurrence of jumps in the printed patterns is prevented.

The motor 17 is preferably a hydraulic motor, the couple or torque of which is essentially constant. This means that the contact pressures between the teeth of the gear wheels 8 and 16 in contact with each other and of the stencil 6 will always be essentially constant, regardless of the speed of rotation. The auxiliary motor 17 can, however, also be an electric mctor, which is fed by means of a suitable control.

According to the invention, it is also possible for an auxiliary motor 20 to be coupled to the main shaft 5 and supplied in such a way that it drives the main shaft 5, in which case a situation corresponding to that shown in FIG. 2 is obtained, the stencil 6 corresponding to the main shaft 5, the gear wheel 8 to a gear wheel of the gear set 7, and the gear wheel 16 to a gear wheel connected to the shaft of an auxiliary motor, such as the auxiliary motor 20.

What is claimed is:

1. In a device for driving at least one rotary screen printing stencil, the device of the type having first main drive means having a first gear wheel and a stencil gear wheel which generally is a circular toothed element which is fixedly connected to the stencil and the axis of the stencil gear wheel coinciding with the axis of the stencil, the first gear wheel meshing with the stencil gear wheel, and the second main drive means for moving a web to be printed at right angles to the axis of the stencil and against the stencil, the first and second main drive means being synchronized with each other, the improvement therein comprising:

first auxiliary drive means for preventing skips or jumps in printing with the stencil and comprising a second gear wheel which meshes with the stencil gear wheel, the first auxiliary drive means further comprising an auxiliary motor adapted for driving said second gear wheel with a constant torque such that one of the first or said second gear wheels drives the stencil and the other of the first or said second gear wheels tends to brake the stencil, whereby skips or jumps in printing with the stencil, which normally can result from play between the first gear wheel and the stencil gear wheel, are prevented.

2. The improvement according to claim 1, wherein the auxiliary motor is a hydraulic motor.

3. An apparatus for driving at least one rotary screen printing stencil and for driving a web against the stencil, said apparatus comprising:

a stencil gear wheel mounted to the stencil;

a first gear wheel in mesh with said stencil gear wheel;

main drive means or driving said first gear wheel for driving the stencil and for driving the web, said main drive means comprising a main motor for driving the stencil and the web in synchronization with each other; and auxiliary drive means for driving or braking said stencil gear wheel for preventing skips during printing due to backlash between said stencil gear wheel and said first gear wheel, said auxiliary drive means comprising a second gear wheel meshing with said stencil gear wheel and an auxiliary constant-torque motor for driving said second gear wheel for driving or braking said stencil gear wheel.

4. An apparatus for driving at least one rotary screen printing stencil and for driving a web against the stencil, said apparatus comprising:

a stencil gear wheel mounted to the stencil;

a first gear wheel in mesh with said stencil gear wheel;

main drive means for driving said first gear wheel for driving the stencil and for driving the web, said main drive means comprising a main motor driving a main shaft for driving the stencil and the web in synchronization with each other; and auxiliary drive means for driving or braking the stencil for preventing skips during printing due to play between said stencil gear wheel and said first gear wheel, said auxiliary drive means comprising a main shaft gear wheel mounted to said main shaft, an auxiliary gear wheel in mesh with said main shaft gear wheel, and an auxiliary constant-torque motor for driving said auxiliary gear wheel.

* * * * *